United States Patent [19]

Achen

[11] 4,323,097

[45] Apr. 6, 1982

[54] TURNTABLE FOR COLORANT DISPENSERS

[76] Inventor: John J. Achen, 1901 5th Ave., Yuma, Ariz. 85364

[21] Appl. No.: 204,500

[22] Filed: Nov. 6, 1980

Related U.S. Application Data

[62] Division of Ser. No. 25,185, Mar. 29, 1979, Pat. No. 4,258,759.

[51] Int. Cl.[3] ..... B65B 43/60

[52] U.S. Cl. ..... 141/168; 141/129; 198/472

[58] Field of Search ..... 141/129, 132, 131, 134, 141/168, 177; 198/472, 646, 648; 222/144

[56] References Cited

U.S. PATENT DOCUMENTS

| | | | |
|---|---|---|---|
| 2,441,774 | 5/1948 | Shaw et al. | 141/132 X |
| 3,122,272 | 2/1964 | Marsh | 222/144 X |
| 3,667,512 | 6/1972 | Jackson | 141/131 X |
| 4,192,362 | 3/1980 | Achen | 141/177 |

*Primary Examiner*—Frederick R. Schmidt
*Attorney, Agent, or Firm*—Cahill, Sutton & Thomas

[57] ABSTRACT

A turntable rotatably supports a plurality of filled paint containers beneath a conventional paint colorant dispenser to permit sequential dispensation of a quantity of colorant into each container from one of the dispensers.

4 Claims, 10 Drawing Figures

TURNTABLE FOR COLORANT DISPENSERS

This is a division of application, Ser. No. 25,185, filed Mar. 29, 1979 now U.S. Pat. No. 4,258,759.

The present invention is directed to apparatus for paint mixing and, more particularly, to apparatus for sequentially locating each of a plurality of paint containers beneath a colorant dispenser.

In paint stores, whether retail or wholesale, standard and custom colors are obtained by adding predetermined quantities of colorants to a standard colored paint container. The colorant dispensers consist of a plurality of canisters mounted in-line or upon a turret. A discharge unit is disposed at the base of each canister for discharging a fixed quantity of tint per discharge operation.

In operation, a container of paint is located in turn beneath the discharge unit of each canister from which a quantity of colorant is to be dispensed to obtain the desired color blend. When the paint in a number of containers is to be blended to a uniform color, it is normal practice to complete blending of each container by adding all of the various colorants to each container before adding any colorant to any of the remaining containers. Uniformity of color of the paint in all of the containers is very subject to the diligence and skill of the operator. As a result, misblending of one or more containers in a batch of containers is the norm and not the exception. Consequently, the amount of waste paint that has to be sold at a discount is substantial.

Normally, one gallon containers of paint are employed unless very large quantities of paint are needed, in which case five gallon paint containers are employed. The former are preferred because of ease in handling. In either case, however, substantial operator time is required to handle the paint containers, whether of the one gallon or five gallon size.

To aid in reducing the physical demands upon an operator and avoid some lifting and manipulation of the paint containers, roller bases have been used. These bases permit sliding movement of each paint container therealong beneath the various colorant dispensers. However, such bases do not alleviate the burden of completely blending each paint container in turn.

Although rotatable stands of various configurations are well known, as reflected in the following U.S. Pat. Nos. 3,004,745, 3,302,594, 3,319,914, 3,479,632, 3,653,340, 3,794,952, 4,117,627 and 4,130,170, such turntables have never been used in conjunction with colorant dispensers for supporting paint containers and permit each colorant to be added to a number of paint containers before the addition of further colorants.

It is therefore a primary object of the present invention to provide an apparatus for serially locating each of a plurality of paint containers beneath each of a colorant dispenser.

Another object of the present invention is to provide apparatus for supporting a plurality of paint containers in operative relationship to a conventional colorant dispenser.

Yet another object of the present invention is to provide apparatus for sequentially adding each of a plurality of colorants to all of a plurality of paint containers.

Still another object of the present invention is to minimize handling time for adding colorants to a plurality of paint containers.

A further object of the present invention is to employ mass production techniques in adding colorants to paint containers.

A yet further object of the present invention is to provide apparatus for adding colorants to paint containers which reduces the probability for misblending error.

A still further object of the present invention is to provide apparatus for increasing the output rate and paint blend uniformity of a plurality of paint containers.

These and other objects of the present invention will become apparent to those skilled in the art as the description thereof proceeds.

The present invention may be described with greater specificity and clarity with reference to the following drawings, in which.

Figure 1:
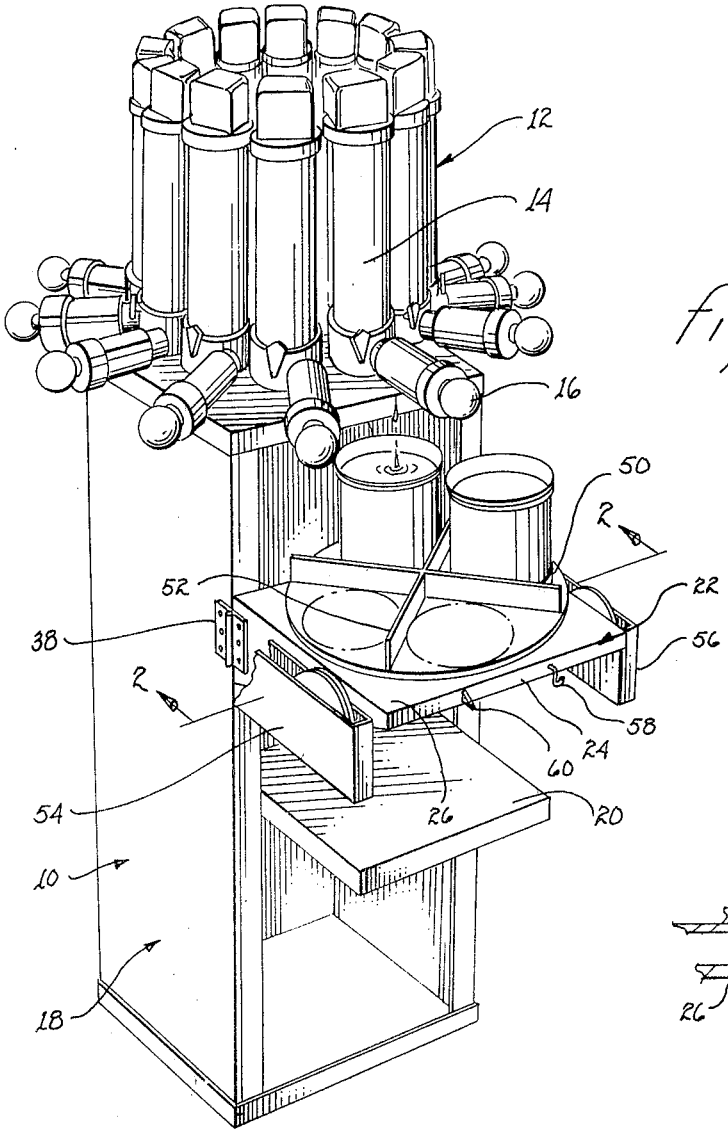
FIG. 1 is a perspective view of the present invention mounted upon a conventional colorant dispenser.
Figure 3:
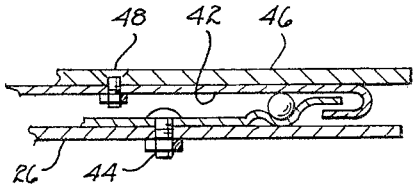
FIG. 3 is a partial cross-sectional view.
Figure 2:
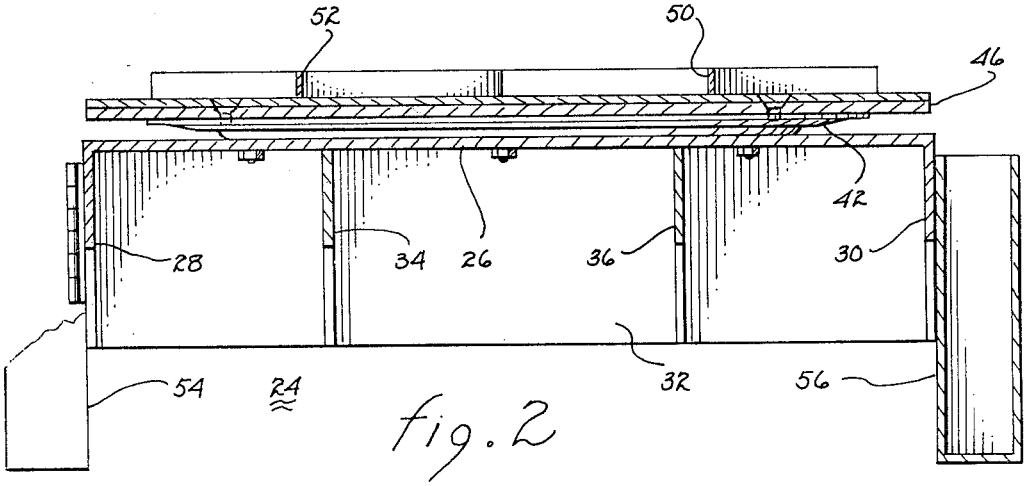
FIG. 2 is a cross-sectional view taken along lines 2—2, as shown in FIG. 1.

Referring to FIG. 1, there is illustrated a conventional colorant dispenser 10, such as the type manufactured by Miller Paint Equipment, Inc., of Addison, Ill. The dispenser includes a turret 12 having a plurality of canisters 14 and attendant discharge units 16. Each canister houses a different colorant, whereby dispensation of colorant from a number of canisters into a paint container can result in the blending of almost any color shade or tint of paint. Framework 18 of the dispenser is sufficiently robust to support turret 12. Additionally, a sliding shelf 20 is incorporated to support each paint container to which colorant is to be added. The vertical location of the shelf is commensurate with either one gallon or five gallon paint cans. From the above description, it will become apparent that a conventional colorant dispenser, such as dispenser 10, is capable of dispensing colorant to the paint containers on a container by container basis only.

Platform 22, attached to dispenser 10, will be described with reference to FIGS. 1, 2, 3, 4 and 5. The platform includes a base 24 having a base plate 26 supported upon vertically depending sides 28, 30 and rear side 32. Additional support ribs 34, 36 extending from rear side 32 along the bottom surface of base plate 26 may be incorporated to add rigidity and strength. A rear corner of base 24 is pivotally attached to framework 18 of colorant dispenser 10 by pivot means, such as hinge 38. The other rear corner of base 24 is releasably locked to framework 18 by latch 40 (see FIG. 4) to prevent unwanted pivotal movement of platform 22. To prevent sag or tilting of the platform due to the weight of the paint containers located thereon, supports 41 and 43 may be attached to framework 18 for supportingly engaging the lower edges of sides 28 and 30.

Figure 4:
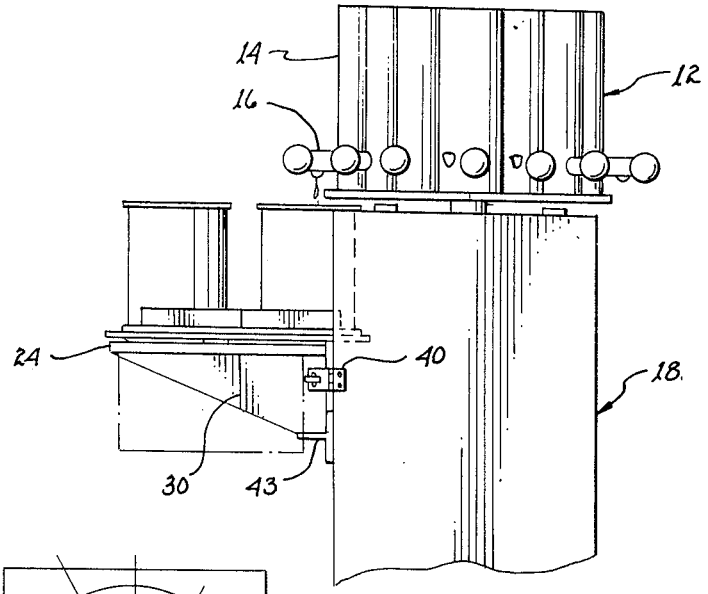
FIG. 4 is a side view illustrating attachment of the present invention to a conventional colorant dispenser.
Figure 5:
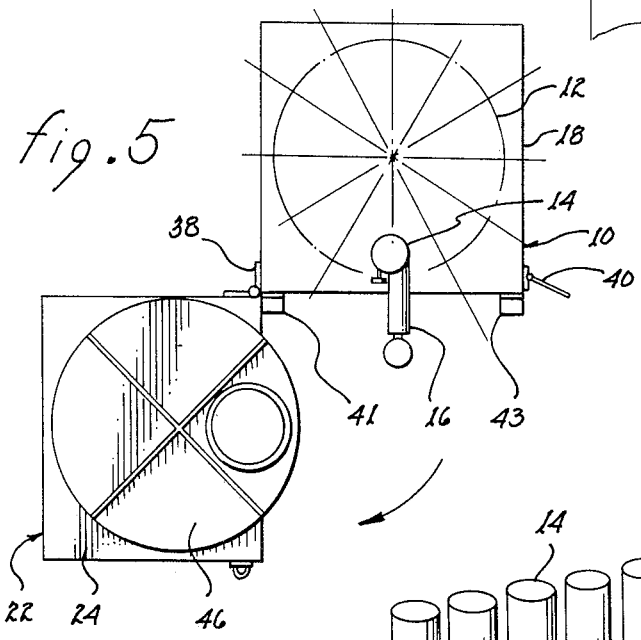
FIG. 5 is a top view illustrating positioning of the apparatus with respect to a conventional colorant dispenser.

By the above described arrangement, platform 22 is pivotally positionable into general vertical alignment with discharge unit 16 of canister 14, as shown in FIGS. 4 and 5. Similarly, the platform is pivotable laterally to permit the placement of large size paint containers upon shelf 20 of framework 18 in vertical proximity to one of the discharge units.

A turn table 42 (see FIG. 3) is attached to base plate 26 of base 24 by nut and bolt means 44. The turntable rotatably supports tray 46 and is attached thereto by nut and bolt means 48. A pair of dividers 50 and 52 are located upon tray 46 to divide the tray, nominally circular into quadrants. The tray is sized such that each quadrant will support a one gallon paint container, as shown in FIGS. 1 and 5.

A compartment 54 is attached adjacent sides 28, which compartment temporarily stores two paint container lids, as shown in FIG. 1. A similar compartment 56 is attached adjacent side 30 of the base to temporarily store two more paint lids. A hook 58 may be located in the edge of base 24 to support a tool for prying the lids off the paint containers. A claw 60 may also extend from base 24 to support a small hammer for replacingly sealing the lids upon the containers after colorant has been added to the contained paint.

In operation, platform 22 is swung into engagement with the front of framework 18 and latch 40 is latched to secure the platform thereto. Each of four paint containers, such as one gallon cans is placed within one of the quadrants of tray 46. The lids are removed from these containers and temporarily stored in one of compartments 54 and 56.

Turret 12 is rotated until one of canisters 14 and respective discharge unit 16 is directly above the paint container nearest the stand, as shown in FIG. 1. Thereafter, a predetermined amount of colorant is added to the container. Subsequently, the same quantity of colorant is added to each of the remaining three containers by serially rotating tray 46 to place the respective paint container beneath the discharge unit. Should a second colorant be added, turret 12 is rotated until the respective canister 14 and discharge unit 16 is directly above the nearmost paint container. Thereafter, colorant is dispensed to each of the paint containers by simply rotating tray 46. On completion of colorant addition, the lids are placed upon the paint containers and sealed by hammering them shut with the aid of the hammer depending from claw 60. The four paint containers may then be removed and replaced with a further set of four paint containers.

By the above description, it becomes evident that colorant is added to each of the set of four paint containers before a second colorant is added to any of the paint containers. This process tends to insure uniformity as between the four paint containers and greatly reduces the possibility of the operator neglecting to add a colorant to one of a batch of paint containers or adding an incorrect quantity of colorant to any one or more paint containers of the batch. Moreover, colorant added to four paint containers as a set rather than adding colorant to each paint container individually, obviates a great deal of the previously required physical effort by an operator associated with paint container handling. Thus, the colorant addition process available from the present invention has a greater degree of probability of being accurate and is far more efficient than conventional processes, as previously described.

In the event colorant is to be added to a single paint container or a paint container sized too large to be placed upon tray 46, platform 22 is swung laterally about hinge 38 after release of latch 40. In this position, illustrated in FIG. 5, shelf 20 is accessible to a discharge unit 16 of one of canisters 14. The single paint container is then placed upon shelf 20 and the appropriate quantity of colorant is added after suitable rotation of turret 12.

Figure 6:
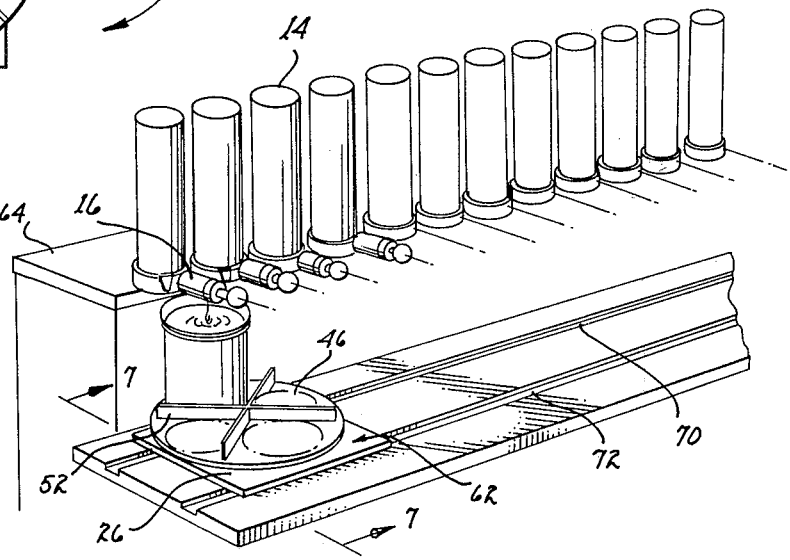
FIG. 6 is a perspective view illustrating a first variant of the present invention.
Figure 7:
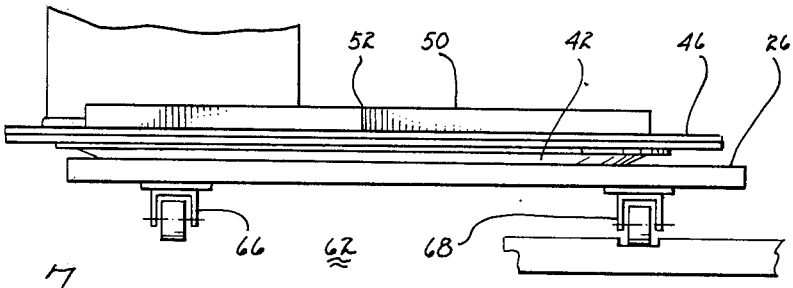
FIG. 7 is a partial end view taken along lines 7—7, as shown in FIG. 6.

Referring to FIGS. 6 and 7, there is shown a first variant 62 of the present invention useable in conjunction with an in-line colorant dispenser 64, such as the type manufactured by the Miller Paint Equipment, Inc., of Addison, Ill. The in-line colorant dispenser includes a plurality of canisters 14 having respective discharge units 16, which canisters are aligned with one another such that the dispensing units extend parallel therefrom in a common place. A base plate 26 rotatably supports tray 46 through turntable 42 disposed therebetween. Nut and bolt means may be employed to secure the respective parts of the turntable to the base plate and the tray. Dividers 50 and 52 extend from tray 46 which tray may be circular, whereby the dividers define quadrants for supporting the paint containers. Base plate 26 is translatably supported by wheel assemblies 66 and 68. These wheel assemblies permit translation of first variant 62 parallel to the in-line colorant dispenser to selectively position one of the tray supported paint containers beneath one of discharge units 16. Translation of tray 26 may be guided by tracks 70 and 72. It is to be understood that although tracks 70 and 72 are shown as channels, they may be raised with suitable modifications to wheel assembly 66 and 68.

In operation, four paint containers are placed upon tray 46 and the first variant is rectilinearly translated until the paint can near most to the colorant dispenser is beneath the discharge unit of the colorant canister containing the colorant to be added. Thereafter, the quantity of colorant is added to each of the paint containers by turning tray 46 to sequentially locate each paint container beneath the discharge unit. This process is repeated should more than one colorant be added to obtain the desired paint blend.

Figure 8:
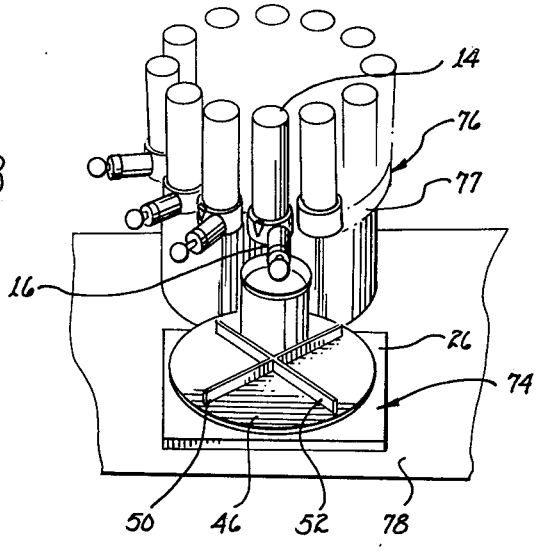
FIG. 8 is a perspective view of a second variant of the present invention.

A second variant 74 is illustrated in FIG. 8. This variant is used in conjunction with a countertop colorant dispensing unit 76, such as the type manufactured by the Miller Paint Equipment, Inc., of Addison, Ill. Variant 74 includes a base 24 supported upon countertop 78. A tray 46 is rotatably supported upon base 24 by means of a turntable (see in example FIG. 3). The tray, which may be circular, is divided into quadrants by dividers 50 and 52, each of which quadrant is sized to support a paint container.

In operation, the paint containers are placed upon tray 46 and turret 77 is rotated until discharge unit 16 of a canister 14 containing the colorant desired becomes positioned above the paint container nearest the turret. A predetermined quantity of colorant is discharged serially into each paint container by repetitively partially rotating tray 46 to place each paint container beneath the discharge unit. Thereafter, should other colorants be added, turret 77 is again rotated until the respective canister and discharge unit is brought into operative relationship with one of the paint containers and the process is repeated.

Figure 9:
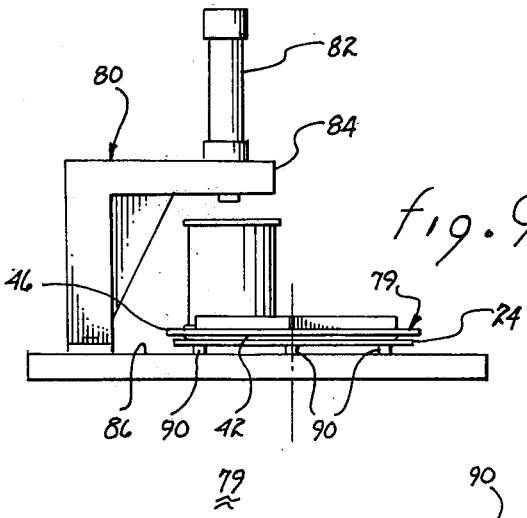
FIG. 9 is an end view of a third variant of the present invention.
Figure 10:
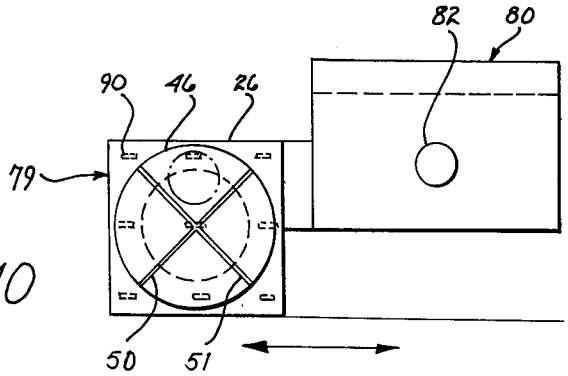
FIG. 10 is a top view of the variant shown in FIG. 9.

Referring to FIGS. 9 and 10, there is shown a third variant 79 employable with an overhead countertop colorant dispenser 80. Colorant dispenser 80 includes a canister 82 extending upwardly from a supporting arm 84, which arm is vertically displaced above countertop 86. Variant 79 includes a base 24 rotatably supporting a tray 46 by means of a turntable 42 (see in example FIG. 3). Dividers 50 and 51 are located upon tray 46, which tray may be circular and divide the tray into quadrants, each quadrant being sized to accommodate a paint container. A plurality of wheel means 90 support base 24 upon counter 86.

In operation, a paint container is located within each of the quadrants of tray 46. Thereafter, base 24 is translated to a point beneath canister 82 to place one of the paint containers vertically therebeneath. A predetermined quantity of colorant is dispensed into the underlying paint container. On rotation of tray 46 another of the paint containers is brought into operative relationship with canister 82 to permit colorant to be dispensed. This process is repeated until all paint containers have received the same specified quantity of colorant. On completion of the colorant addition process, base 24 is translated laterally from underneath arm 84 to permit removal of the paint containers from tray 46.

In summary, it will become evident that the present invention and each of its variants, provide a means for sequentially adding a colorant to each of a plurality of containers until all colorants to be added have been added. This process is efficient and it promotes uniformity in the resulting color blend by minimizing the possibility of an operator forgetting to add colorant or adding an incorrect amount of colorant. Thus, the present invention effects savings in terms of a reduction of loss of miscolored paint and further saving by promoting greater efficiency through elimination of many of the conventional paint container handling steps.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A platform for locating each paint container of a set of paint containers in sequential operating relationship with a colorant discharge unit of a colorant dispenser, said platform comprising in combination:

(a) a tray for supporting the set of paint containers;

(b) divider means mounted on said tray for defining a plurality of radially expanding delineations upon said tray and for accommodating any sized circular paint container within a predetermined size range, said divider means including means for channeling and guiding the paint containers into a predetermined position on placement of the paint containers thereon, said channeling and guiding means including means for restraining tipping of the paint containers and spilling of the contained paint;

(c) a base locatable beneath at least one of the discharge units of the colorant dispenser said base including means for rectilinearly translating said tray to rectilinearly reposition the set of paint containers as a unit from one discharge unit to another;

(d) means for rotatably supporting said tray on said base to position each of the paint containers in sequence beneath each selected one of the discharge units;

whereby, each selected colorant is dispensed sequentially into all of the containers of the set of containers to enhance uniformity of color of the paint in the set of containers.

2. The platform as set forth in claim 1 wherein said translating means includes a set of tracks and a set of rotating elements for guidingly engaging said set of tracks.

3. The platform as set forth in claim 2 wherein said set of rotating elements is attached to said base.

4. The platform as set forth in claim 3 wherein said tray is circular and wherein said divider means comprises a pair of orthogonally oriented vertically extending flanges to divide said tray into quadrants.

* * * * *